US008217307B2

(12) United States Patent
Chu

(10) Patent No.: US 8,217,307 B2
(45) Date of Patent: Jul. 10, 2012

(54) FIXING STRUCTURE FOR HEATING MODULE OF HAIR DRYER

(75) Inventor: Yunyuan Chu, Taipei (TW)

(73) Assignee: Jui Harvest Co., Ltd., Tortola (VG)

( * ) Notice: Subject to any disclaimer, the term of this patent is extended or adjusted under 35 U.S.C. 154(b) by 301 days.

(21) Appl. No.: 12/739,566

(22) PCT Filed: Oct. 30, 2007

(86) PCT No.: PCT/CN2007/003086

§ 371 (c)(1),
(2), (4) Date: Apr. 23, 2010

(87) PCT Pub. No.: WO2009/052662

PCT Pub. Date: Apr. 30, 2009

(65) Prior Publication Data

US 2010/0301031 A1 Dec. 2, 2010

(30) Foreign Application Priority Data

Oct. 25, 2007 (CN) ..... 2007 1 0165643

(51) Int. Cl.
*H05B 1/00* (2006.01)
*H05B 3/00* (2006.01)
*H05B 11/00* (2006.01)

(52) U.S. Cl. ..... 219/209

(58) Field of Classification Search ..... 219/209
See application file for complete search history.

(56) References Cited

U.S. PATENT DOCUMENTS 4,382,174 A * 5/1983 Barns ..... 392/410
5,996,243 A * 12/1999 Chang et al. ..... 34/97

FOREIGN PATENT DOCUMENTS

WO 2009052662 4/2009

OTHER PUBLICATIONS

International Search Report for PCT/CN2007/003086 in Chinese.
International Search Report for PCT/CN2007/003086 in English.

* cited by examiner

*Primary Examiner* — Theresa T Doan
(74) *Attorney, Agent, or Firm* — WPAT, P.C.; Anthony King

(57) ABSTRACT

A fixing structure for fixing a heating module of a hair dryer is provided. The fixing structure includes a heat-emitting ceramic, a voltage step-down ceramic, a ceramic sleeve, and a conductive metal bolt. Through holes are configured in centers of the heat-emitting ceramic and the voltage step-down ceramic. Heat-emitting films are coated on surfaces of the heat-emitting ceramic. Silver paste films are respectively coated on the upper and lower end surfaces of the heat-emitting ceramic and the voltage step-down ceramic to form silver paste electrodes. A through hole is configured at the center of the ceramic sleeve. The ceramic sleeve is assembled through the through holes of the heat-emitting ceramic and the voltage step-down ceramic. The conductive metal bolt is assembled through of the ceramic sleeve for fixing the heat-emitting ceramic and the voltage step-down ceramic on the supporting frame seat of the motor and fan of the hair dryer.

8 Claims, 3 Drawing Sheets

FIXING STRUCTURE FOR HEATING MODULE OF HAIR DRYER

BACKGROUND OF THE INVENTION

1. Field of the Invention

The present invention relates generally to a fixing structure adapted for fixing a heating module of a hair dryer, and more particularly, to a heating module of a hair dryer. The heating module includes a heat-emitting ceramic and the heat-emitting ceramic is not covered by any plastic component. As such, the heat generated by the heat-emitting ceramic of the heating module won't melt any plastic component and destroy the fixing structure for fixing the heating module.

2. The Prior Arts

Hair dryer is a product very frequently used in people's daily life. Currently, hair dryers often employ heat-emitting ceramics for emitting far infrared radiation. However, if the heat generated by the far infrared radiation is not properly dissipated, the heating module may achieve a temperature up to 300° C. or above. Generally, when a fixing structure used for fixing such a heating module is made of plastic, the plastic fixing structure may be destroyed by such a high temperature, and the heating module may be melt thereby.

As such, it is highly desired to develop a fixing structure for fixing a heating module of a hair dryer, so that the heating module is prevented from being damaged by the heat generated by the heat-emitting ceramic, thus improving the life span of the hair dryer.

SUMMARY OF THE INVENTION

A primary objective of the present invention is to provide a fixing structure for fixing a heating module of a hair dryer. The fixing structure of the heating module won't be damaged by the heat generated by the heat-emitting ceramic of the heating module.

The present invention provides a fixing structure for fixing a heating module of a hair dryer. The fixing structure includes a heat-emitting ceramic, a voltage step-down ceramic, a ceramic sleeve, and a conductive metal bolt.

The heat-emitting ceramic includes a first through hole configured at a center of the heat-emitting ceramic. A heat-emitting film is coated on a surface of the heat-emitting ceramic. The heat-emitting ceramic has an upper end surface and a lower end surface. Silver paste films are respectively coated on the upper end surface and the lower end surface of the heat-emitting ceramic for configuring silver paste electrodes thereon respectively. When a power supply is provided over the silver paste electrodes configured on the upper end surface and the lower end surface of the heat-emitting ceramic, the heat-emitting film obtains power so that the heat-emitting ceramic is heated up.

The voltage step-down ceramic includes a second through hole and a plurality of passing holes. The second through hole is configured at a center of the voltage step-down ceramic and is positionally corresponding to the first through hole of the heat-emitting ceramic. The second through hole is preferably configured with the same shape of the first through hole. The passing holes are uniformly distributed around the second through hole. The voltage step-down ceramic has an upper end surface and a lower end surface. Silver paste films are respectively coated on the upper end surface and the lower end surface of the voltage step-down ceramic for configuring silver paste electrodes thereon respectively. The voltage step-down ceramic is disposed at one of the upper end surface and the lower end surface of the heat-emitting ceramic. The first through hole of the heat-emitting ceramic and the second through hole of the voltage step-down ceramic are aligned with each other. In such a way, one of the upper end surface and the lower end surface of the heat-emitting ceramic is in direct contact with one of the lower end surface and the upper end surface of the voltage step-down ceramic.

The ceramic sleeve includes a third through hole configured at a center of the ceramic sleeve. The ceramic sleeve is assembled through the first through hole and the second through hole. The third through hole is positioned in parallel with the first through hole and the second through hole.

The conductive metal bolt is assembled in the third through hole of the ceramic sleeve, so as to fix the heat-emitting ceramic and the voltage step-down ceramic onto a motor and a fan frame of the hair dryer.

The present invention has the following advantages. The heat-emitting ceramic of the heating module of the hair dryer is substantially remained away from any plastic component, so that the heat generated by the heating module won't damage the hair dryer. In case the heat-emitting ceramic is improperly used to cause an undesired high temperature, the structure of the heating module would not be destroyed. In such a way, the life span of the hair dryer can be prolonged.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
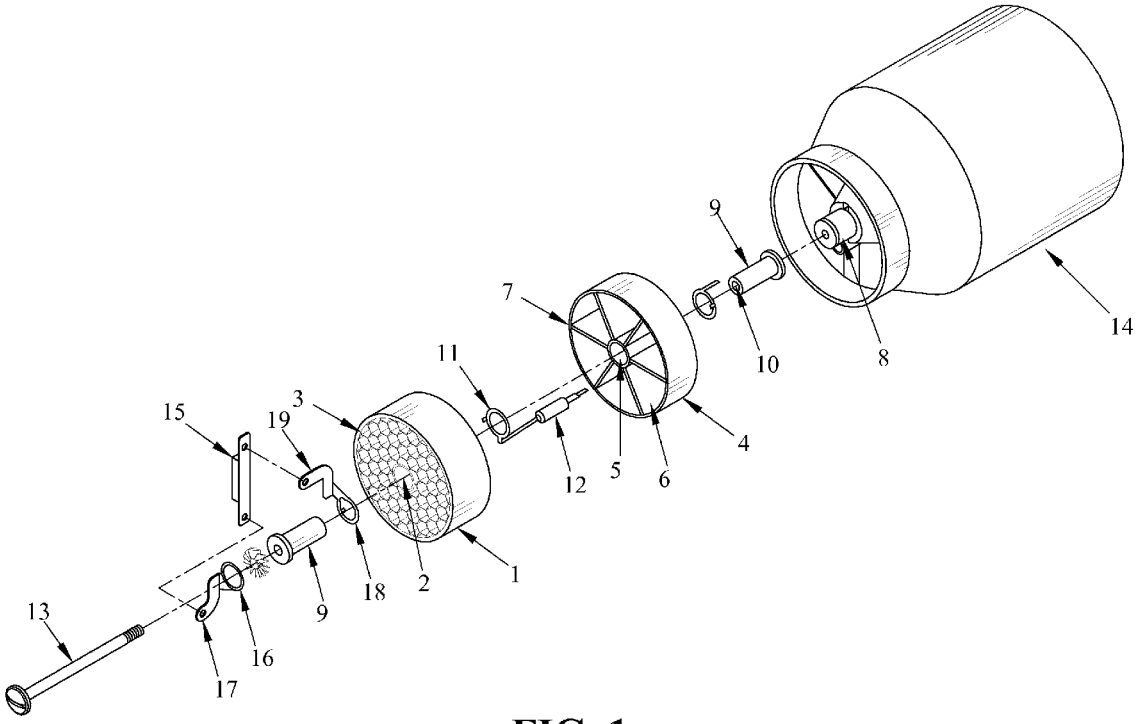
FIG. 1 is an exploded perspective view of the fixing structure for fixing a heating module of a hair dryer according to an embodiment of the present invention.

The accompanying drawings are included to provide a further understanding of the invention, and are incorporated in and constitute a part of this specification. The drawing illustrates embodiments of the invention and, together with the description, serves to explain the principles of the invention.

Figure 2:
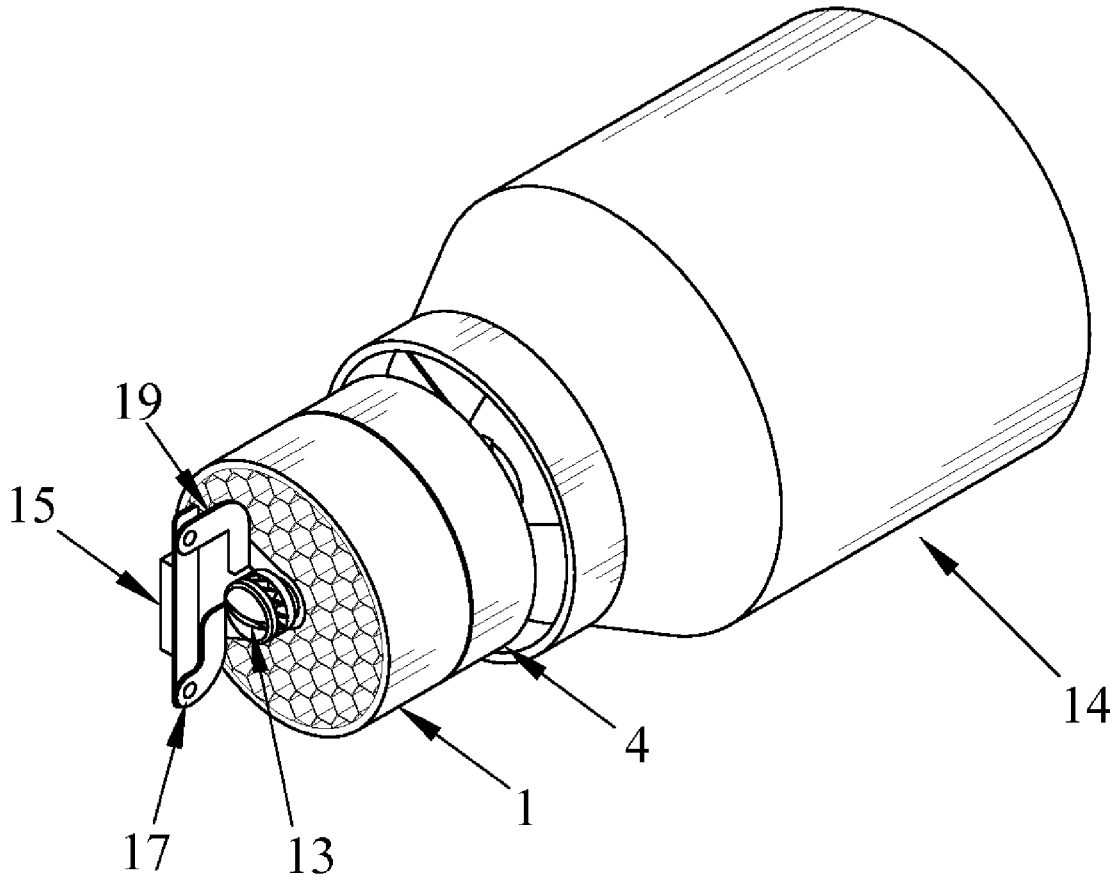
FIG. 2 is a perspective view of the fixing structure.
Figure 3:
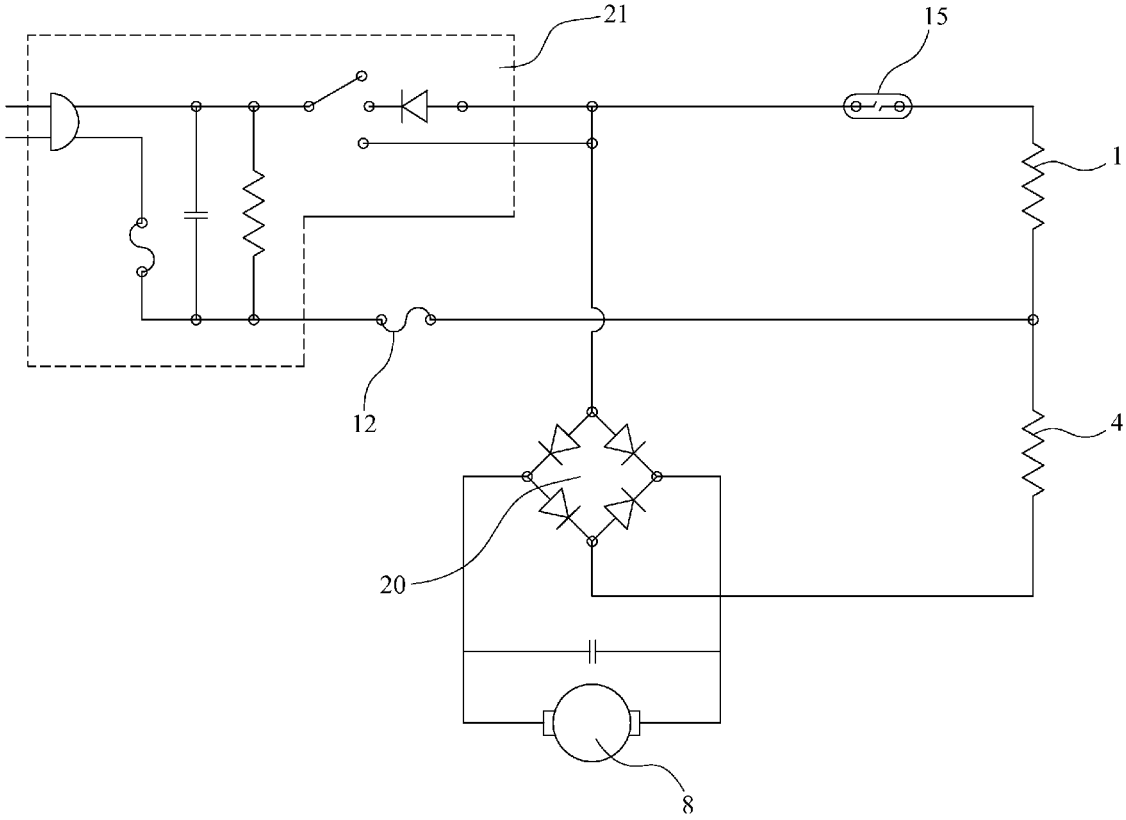
FIG. 3 is a circuit diagram of the fixing structure.

FIG. 1 is an exploded perspective view of the fixing structure for fixing a heating module of a hair dryer according to an embodiment of the present invention. FIG. 2 is a perspective view of the fixing structure. FIG. 3 is a circuit diagram illustrating the fixing structure. Referring to FIGS. 1 through 3, there is shown a fixing structure for fixing a heating module of a hair dryer. The fixing structure includes a heat-emitting ceramic 1, a voltage step-down ceramic 4, at least one ceramic sleeve 9, and a conductive metal bolt 13.

The heat-emitting ceramic 1 includes a first through hole 2 configured at a center of the heat-emitting ceramic 1, and a plurality of honeycomb through holes configured surrounding the first through hole 2. A heat-emitting film is coated on a surface of the heat-emitting ceramic 1. The heat-emitting ceramic has an upper end surface and a lower end surface. Silver paste films are respectively coated on the upper end surface and the lower end surface of the heat-emitting ceramic for configuring silver paste electrodes 3 on the upper end surface and the lower end surface of the heat-emitting ceramic respectively. When a power supply is provided over the silver paste electrodes configured on the upper end surface and the lower end surface of the heat-emitting ceramic, the heat-emitting film obtains power so that the heat-emitting ceramic is heated up. The heat-emitting film is preferred to be, but not restricted to be a heat-emitting thick film (e.g., a carbon film), or a heat-emitting thin film (e.g., nano-scale semiconductor film).

The voltage step-down ceramic 4 includes a second through hole 5 and a plurality of passing holes 6. The second through hole 5 is configured at a center of the voltage step-down ceramic 4 and is positionally corresponding to the first through hole 2 of the heat-emitting ceramic 1. The second through hole 5 is preferably configured with the same shape of the first through hole 2. The passing holes 6 are uniformly distributed around the second through hole 5. As shown in FIG. 1, the voltage step-down ceramic 4 has an upper end surface and a lower end surface. Silver paste films are respectively coated on the upper end surface and the lower end surface of the voltage step-down ceramic 4 for configuring silver paste electrodes 7 thereon respectively. The voltage step-down ceramic 4 is disposed at one side of the heat-emitting ceramic 1. The first through hole 2 of the heat-emitting ceramic 1 and the second through hole 5 of the voltage step-down ceramic 4 are aligned with each other. In such a way, one of the upper end surface and the lower end surface of the heat-emitting ceramic 1 is in direct contact with one of the lower end surface and the upper end surface of the voltage step-down ceramic 4, so that the silver paste electrodes 3 and 7 configured on the end surfaces in direct contact are electrically coupled with each other. The electrically coupled silver paste electrodes 3 and 7 are then coupled to a power supply 21 of the hair dryer.

According to an embodiment of the present invention, the voltage step-down ceramic 1 is also coated with a heat-emitting film which is same as the heat-emitting film coated on the heat-emitting ceramic 1. The silver paste electrodes 3 and 7 configured on the voltage step-down ceramic 4 and the heat-emitting ceramic 1 constitute a parallel circuit. As shown in FIG. 3, the silver paste electrode 7 configured on the other end surface of the voltage step-down ceramic 4 is serially coupled to a motor 8 of the hair dryer via a rectifier circuit, and is then, together with the silver paste electrode 3 of the other end surface of the heat-emitting ceramic 1, coupled to the power supply of the hair dryer. In such a circuit architecture, the voltage step-down ceramic 4 is substantially equivalent to a divider resistor. After rectifying in accordance with the voltage dividing principle, a direct current low voltage is provided to the motor 8 of the hair dryer. In such a way, the motor 8 of the hair dryer is maintained working within a rated voltage range, typically DC 12V to 36V.

The ceramic sleeve 9 includes a third through hole 10 configured at a center of the ceramic sleeve 9. The ceramic sleeve 9 is assembled through the first through hole 2 and the second through hole 5. The third through hole 10 is positioned in parallel with the first through hole 2 and the second through hole 5.

The conductive metal bolt 13 is assembled in the third through hole 10 of the ceramic sleeve 9, so as to fixing the heat-emitting ceramic 1 and the voltage step-down ceramic 4 onto supporting frame seat 14 of a motor 8 and a fan of the hair dryer.

In general, the ceramic sleeve 9 is adapted for positioning the heat-emitting ceramic 1, the voltage step-down ceramic 4 relative to the conductive metal bolt 13, and providing an insulation of the heat-emitting ceramic 1, the voltage step-down ceramic 4 from the conductive metal bolt 13.

In addition, for achieving a higher safety tier, the hair dryer may further include a temperature control switch 15 connected between the conductive metal bolt 13 and the heat-emitting ceramic 1. In case the wind channel of the hair dryer is jammed or the motor 8 or the fan element is caused with a failure, the temperature control switch 15 is jumped open, and when the temperature is lowered down to the rated temperature, the temperature control switch 15 is again turned on to conducting. According to an aspect of the embodiment of the present invention, a first gasket member 16 is provided between the conductive metal bolt 13 and the ceramic sleeve 9. The first gasket member 16 is configured with a first connection portion 17. A second gasket member 18 is provided between the heat-emitting ceramic 1 and the ceramic sleeve 9. The second gasket member 18 is configured with a second connection portion 19. The temperature control switch 15 has two ends respectively coupled with the first connection portion 17 and the second connection portion 19. The first gasket member 16 and the second gasket member 18 are made of an electrical conductive material, respectively, and are adapted for supplying the power supply via the conductive metal bolt 13, the first connection portion 17, the temperature control switch 15, and the second connection portion 19 in sequence to the heat-emitting ceramic 1.

According to a further embodiment of the present invention, the hair dryer further includes a contact point gasket 11 connecting with a temperature fuse 12 for providing a further protection to the hair dryer. In case any failure occurs, the temperature may exceed the rated temperature, and the temperature fuse 12 is then blown to cut off the circuit. In such a way, the heat-emitting ceramic 1 and the voltage step-down ceramic 4 are not supplied with any power supply, and won't generate heat anymore, so as to avoid more serious damage and danger.

The present invention has the following advantages. The heat-emitting ceramic of the heating module of the hair dryer is substantially remained away from any plastic component, so that the heat generated by the heating module won't damage the hair dryer. In case the heat-emitting ceramic is improperly used to cause an undesired high temperature, the structure of the heating module would not be destroyed. In such a way, the life span of the hair dryer can be prolonged.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A fixing structure for fixing a heating module of a hair dryer, comprising:

a heat-emitting ceramic, comprising a first through hole configured at a center thereof, wherein a heat-emitting film is coated on a surface of the heat-emitting ceramic, and silver paste films are coated on an upper end surface and a lower end surface of the heat-emitting ceramic to form silver paste electrodes thereon respectively, wherein a power supply is provided to the heat-emitting film via the silver paste electrodes, so as to allow the heat-emitting ceramic to generate heat;

a voltage step-down ceramic, comprising a second through hole configured at a center of the voltage step-down ceramic and positionally corresponding to the first through hole of the heat-emitting ceramic, and a plurality of passing holes uniformly distributed around the second through hole, wherein silver paste films are respectively coated on an upper end surface and a lower end surface of the voltage step-down ceramic to configure silver paste electrodes thereon respectively, wherein the voltage step-down ceramic is disposed in contact with one of the upper end surface and the lower end surface of the heat-emitting ceramic, wherein the first through hole of the heat-emitting ceramic and the second through hole of the voltage step-down ceramic are aligned with each other, and silver paste electrodes on the contacted end surfaces of the heat-emitting ceramic and the voltage step-down ceramic are electrically connected with each other;

a ceramic sleeve, assembled through the first through hole and the second through hole, wherein the ceramic sleeve comprises a third through hole, and the third through hole is positioned in parallel with the first through hole and the second through hole; and a conductive metal bolt, assembled in the third through hole of the ceramic sleeve, for fixing the heat-emitting ceramic and the voltage step-down ceramic onto a supporting frame seat of a motor and a fan of the hair dryer.

2. The fixing structure as claimed in claim 1, wherein the ceramic sleeve comprises a first section and a second section, wherein the first section of the ceramic sleeve is assembled through the first through hole and the second section of the ceramic sleeve is assembled through the second through hole.

3. The fixing structure as claimed in claim 1, further comprising:

a temperature control switch connected between the conductive metal bolt and the heat-emitting ceramic;

a first gasket member, disposed between the conductive metal bolt and the ceramic sleeve, wherein the first gasket member is configured with a first connection portion; and a second gasket member, disposed between the heat-emitting ceramic and the ceramic sleeve, wherein the second gasket member is configured with a second connection portion, wherein the temperature control switch has two ends electrically coupled to the first connection portion and the second connection portion, respectively.

4. The fixing structure as claimed in claim 1, further comprising a contact point gasket disposed between the heat-emitting ceramic and the voltage step-down ceramic, wherein the contact point gasket is connected with a temperature fuse.

5. The fixing structure as claimed in claim 3, wherein the first gasket member and the second gasket member are all made of conductive materials for supplying the power supply via the conductive metal bolt, the first connection portion, the temperature control switch, and the second connection portion in sequence to the heat-emitting ceramic.

6. The fixing structure as claimed in claim 1, wherein the heat-emitting film is a heat-emitting thick film or a heat-emitting thin film.

7. The fixing structure as claimed in claim 6, wherein the heat-emitting thick film is a carbon film.

8. The fixing structure as claimed in claim 6, wherein the heat-emitting thin film is a nano-scale semiconductor film.

* * * * *